US005341612A

United States Patent [19]

Robbins

[11] Patent Number: 5,341,612

[45] Date of Patent: Aug. 30, 1994

[54] BAFFLE VENT STRUCTURE

[75] Inventor: Gary L. Robbins, Springfield, Ill.

[73] Assignee: Inno-Tech Plastics, Inc., Springfield, Ill.

[21] Appl. No.: 913,832

[22] Filed: Jul. 16, 1992

[51] Int. Cl.[5] ..... E04B 7/18

[52] U.S. Cl. ..... 52/95; 52/302.3; 52/302.6

[58] Field of Search ..... 52/95, 198, 199, 302.6, 52/302.7, 304, 481, 406, 407, 92, 96, 97, 57, 58; 44/42, 35

[56] References Cited

U.S. PATENT DOCUMENTS

| | | | |
|---|---|---|---|
| 1,976,166 | 10/1934 | Friedberg | 52/302.6 |
| 2,122,926 | 7/1938 | Blacher | 52/302.6 |
| 2,154,734 | 4/1939 | Doing | 52/302.6 |
| 3,293,810 | 12/1966 | Cox et al. | 52/302.6 |
| 3,683,785 | 8/1972 | Grange . | |
| 4,016,700 | 4/1977 | Blomstedt | 52/481 |
| 4,102,092 | 7/1978 | Ward . | |
| 4,125,971 | 11/1978 | Ward . | |
| 4,214,510 | 7/1980 | Ward . | |
| 4,237,672 | 12/1980 | Peterson . | |
| 4,406,095 | 9/1983 | Slavik . | |
| 4,446,661 | 5/1984 | Jonsson et al. . | |
| 4,660,463 | 4/1987 | Bottomore et al. . | |
| 4,745,716 | 5/1988 | Kuypers | 52/302.3 |
| 4,916,875 | 4/1990 | Kashiwagi | 52/302.3 |
| 4,995,308 | 2/1991 | Waggoner . | |

FOREIGN PATENT DOCUMENTS 2145765A 4/1985 United Kingdom .

*Primary Examiner*—Carl D. Friedman
*Assistant Examiner*—Winnie Yip

[57] ABSTRACT

A baffle vent is provided for positioning against the underside of a roof to direct air from the soffit area of the roof upwardly over the interior surface of the roof. The baffle vent is an elongated self-supporting unitary structure of sheet-like material having a generally channel-shaped cross-section defining longitudinal side walls joined by a bottom wall. Attachment flanges project from the top edges of the side walls for facilitating attaching the baffle vent to the underside of the roof. An integral longitudinal reinforcing rib is provided in the bottom wall, running along a substantial length of the baffle vent, generally parallel to the side walls, to resist collapsing of the baffle vent if subjected to external forces such as from roof insulation, handling, shipping and the like. A structure is contemplated with a plurality of the reinforcing ribs spaced in an in-line orientation longitudinally of the bottom wall, whereby the structure can be cut to length between adjacent ends of a pair of spaced in-line ribs.

14 Claims, 1 Drawing Sheet

Fig. 2
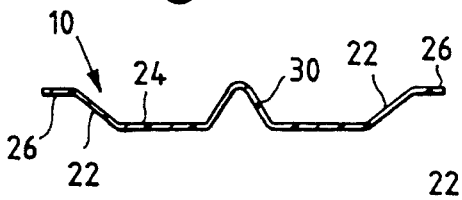
Fig. 1
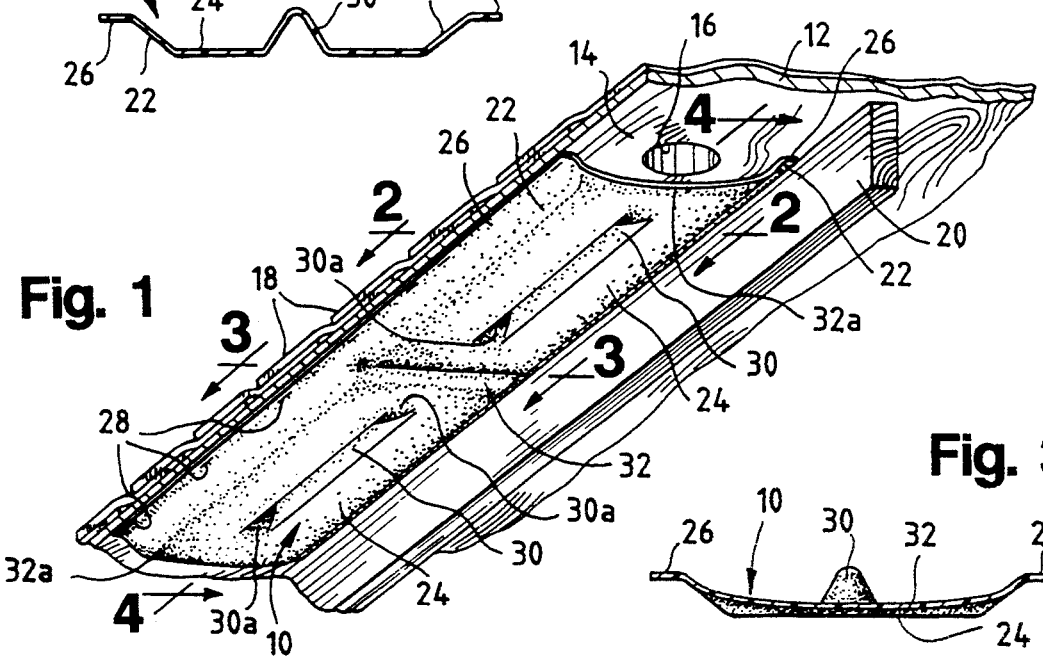
Fig. 3
Fig. 4
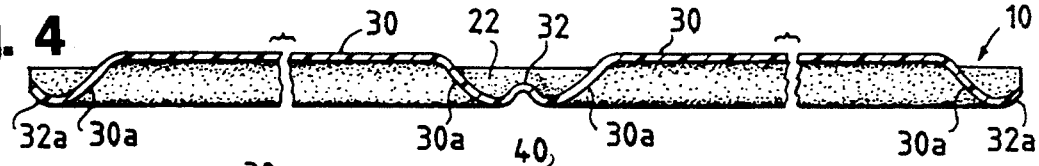
Fig. 6
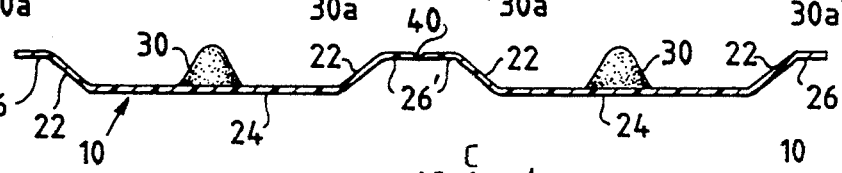
Fig. 5
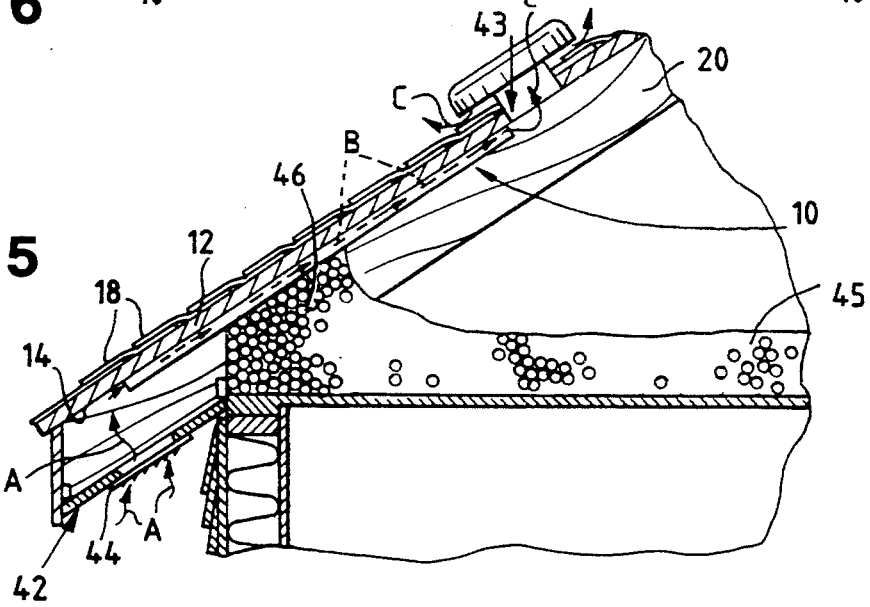

BAFFLE VENT STRUCTURE

FIELD OF THE INVENTION

This invention relates to a baffle vent structure for positioning against the underside of a roof to direct air from the soffit area of the roof upwardly over the interior surface of the roof.

BACKGROUND OF THE INVENTION

It has been known to provide various forms of baffles in roofing structures to direct or channel air along the underside of the roof, usually from the soffit area of the roof upwardly toward vent ducts or a crest or ridge vent. Such baffle vents often are called "vent chutes". The baffle vents provide barriers to separate the interior surface of the roof from the attic area and from such extraneous materials as insulation which might be located near the underside of the roof. The baffles direct the air against the surface of the roof, eliminate the build-up of moisture and prevent ice formations during winter months.

A major consideration in the design and manufacture of baffle vents of the character described, always has been in the cost of such structures. Taking into consideration the large square footage of the roofs of buildings, such as residential homes, it has been a goal to design baffle vents so that they do not add appreciably to the cost of construction. Consequently, heretofore, baffle vents have been fabricated extensively of foam material in sheets and formed to be self-supporting so that the vents can be handled and manipulated into position for attachment against the interior surface of a roof.

Specifically, such baffle vents conventionally are narrow elongated structures so that they fit between the rafters of a roof structure. When the use of foam material was initiated in fabricating such baffle vents, the structures originally were relatively thick and of a simple channel configuration in cross-section so as to be self-supporting. Such thick structures were relatively expensive and added appreciably to the cost of construction. Attempts have been made to fabricate baffle vents of a thinner foam sheet material, along with formed reinforcing ribs which extend transversely across the narrow dimensions of the elongated structures to reduce cost and to provide additional self-supporting reinforcements.

This invention is directed to further improvements in the art of roof-line baffle vents to provide an improved reinforced structure to prevent the vents from collapsing during shipping, handling and installation, as well as to prevent collapsing of the vents from compacted insulation which often is blown into attic areas of a building against the underside of the baffle vents.

SUMMARY OF THE INVENTION

An object, therefore, of the invention is to provide a new and improved baffle vent of the character described.

In the exemplary embodiment of the invention, a baffle vent is disclosed for positioning against the underside of a roof to direct air from the soffit area of the roof upwardly over the interior surface of the roof. The baffle vent is an elongated self-supporting unitary structure of sheet-like material having a generally channel-shaped cross-section defining longitudinal side walls joined by a bottom wall. Generally, attachment means are provided on the side walls for facilitating attaching the baffle vent to the underside of the roof. Integral longitudinal reinforcing rib means are provided in the bottom wall, running along a substantial length of the baffle vent, generally parallel to the side walls, to resist collapsing of the baffle vent if subjected to external forces such as from handling, shipping, roof insulation, and the like.

More particularly, the unitary baffle vent is fabricated of extruded polystyrene foam material. The attachment means are provided by flanges integral with and running the length of the top edges of the side walls of the structure. The longitudinal reinforcing rib means are provided by a reinforcing rib extending lengthwise of the bottom wall generally centrally of the bottom wall transversely thereof. The reinforcing rib has ramped ends tapering into the bottom wall of the structure. An integral transverse reinforcing rib extends across the bottom wall at each opposite end of the structure.

The invention also contemplates fabricating the baffle vent structure in an incremental fashion so that the structure can be cut to various lengths depending upon the span of the roof from the soffit area to the crest-line of the roof. Specifically, a plurality of the longitudinal reinforcing ribs are spaced lengthwise of the structure in an in-line orientation longitudinally of the bottom wall. The structure thereby can be cut to lengths between adjacent ends of a pair of spaced in-line ribs. For instance, the structure can be designed for cutting in two-foot increments to provide a baffle vent which is two feet long, four feet long, six feet long, etc. Each longitudinal rib is less than two feet in length so that the structure can be cut between adjacent ends of the in-line ribs to provide varying lengths of baffle vents for particular applications.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a fragmented perspective view illustrating a baffle vent structure according to the invention, attached to the underside of a roof structure inside a rafter of the roof;

FIG. 2 is a vertical section taken generally along line 2—2 of FIG. 1;

FIG. 3 is a vertical section taken generally along line 3—3 of FIG. 1;

FIG. 4 is a vertical section taken generally along line 4—4 of FIG. 1;

FIG. 5 is a somewhat schematic illustration of the location of the baffle vent structure, running from the soffit area of a roof upwardly over the interior surface of the roof toward a roof vent; and FIG. 6 is a transverse section through a baffle vent structure having a pair of interconnected side-by-side channels.

DETAILED DESCRIPTION OF THE PREFERRED EMBODIMENT

Referring to the drawings in greater detail, and first to FIG. 1, the invention is embodied in a baffle vent structure, generally designated 10, for positioning against the underside of a roof 12 to direct air from the soffit area of the roof upwardly over an interior surface 14 of the roof toward a vent 16 in the roof. The roof construction is shown to have outside shingles 18, along with one of the rafters 20 which support the roof. Baffles vent 20 is an elongated structure and is designed for positioning between adjacent rafters 20 of the roof construction.

More particularly, referring to FIGS. 2–4 in conjunction with FIG. 1, baffle vent 10 is an elongated unitary structure of self-supporting sheet-like material having a generally channel-shaped cross-section defining longitudinal side walls 22 joined by a bottom wall 24. Attachment means in the form of integral flanges 26 project outwardly from the top edges of side walls 22 for facilitating attaching the baffle vent to the underside 14 of roof 12. For instance, the flanges may be stapled to the underside of the roof, as by staples 28. Therefore, when attached to the underside of the roof, the channel-shaped baffle vent defines a duct or chute for directing air longitudinally within the baffle vent against the interior surface of the roof.

Generally, baffle vent 10 is fabricated of extruded polystyrene foam material. Specifically, the material is provided in sheet form of approximately 80 mil thick. The sheet material then is thermally formed to the configuration disclosed herein, whereupon the thickness of the material expands to approximately 100–120 mils thick. Such a structure provides a relatively inexpensive product. However, although such material in a simple channel-shaped configuration is self-supporting, it has been found that additional reinforcements are desirable to prevent the structure from collapsing during shipping, handling and installation, and further to prevent the structure from collapsing under external forces such as compacted insulation which often is blown under pressure into the attic area of a roof immediately beneath the installed baffle vents. The insulation becomes compacted particularly against the underside of the baffle vents near the soffit area of the roof.

Generally, the invention contemplates the provision of integral longitudinal reinforcing rib means in bottom wall 24 running along a substantial length of the baffle vent. Specifically, FIGS. 1–4 show that baffle vent 10 has a pair of longitudinal reinforcing ribs 30 running generally parallel to side walls 22, with the ribs being located generally centrally of bottom wall 24 transversely thereof. The ribs are generally triangularly shaped in cross-section as seen in FIGS. 2 and 3, to provide for a truss-like reinforcement. In addition, as seen best in FIG. 4, opposite ends **30*a* of the ribs are angled or ramped to taper into bottom wall 24**, again to provide a sort of triangulated truss-like reinforcement.

In addition, it can be seen in FIGS. 1 and 4 that adjacent ends **30*a* of the pair of ribs 30 are spaced from each other, and an integral transverse reinforcing rib 32 extends across bottom wall 24 between side walls 22. Transverse reinforcing ribs 32*a* also extend across bottom wall 24 at each opposite end of the overall baffle vent structure. As will be explained in greater detail below, integral transverse reinforcing ribs 32*a* are one-half the width of transverse reinforcing rib 32**.

The invention contemplates that baffle vent 10 be fabricated so that it can be cut in increments and still include at least one integral longitudinal rib 30, including its ramped ends **30*a*. Specifically, referring to FIG. 1, it can be seen that baffle vent 10 is of a length to include a pair of integral longitudinal ribs 30 with their adjacent ends 30*a* spaced from each other, and with integral transverse rib 32 disposed between the spaced ends 30*a*. The length from transverse rib 32 to each opposite end of the baffle vent structure (i.e. between rib 32 and either end rib 32*a*) may be on the order of two feet. Therefore, baffle vent structure 10 shown in FIG. 4 is approximately four feet long. In fabrication, a baffle vent construction can be made of a continuing length and be cut into two, four, six, eight, etc. lengths simply by cutting through a rib 32 as a guide. If a baffle vent section is only two feet long, it still will include only one longitudinal reinforcing rib 30. If the baffle vent section is four feet long, as represented by FIG. 1, the baffle vent structure will include two spaced longitudinal ribs 30. If the baffle vent structure is six feet long, it will include three longitudinal reinforcing ribs 30**, and so on.

Therefore, regardless of the particular incremental length of the baffle vent, it will include at least one integral longitudinal reinforcing rib 30, along with its ramped ends **30*a*. This incremental concept provides identical reinforcements regardless of the incremental length of the baffle vent structure and is advantageous because the roof line between the soffit area and the crest of a given roof construction can vary. In addition, regardless of the incremental cut length, each opposite end of the baffle vent structure will have a reinforcing transverse rib 32*a***. Of course, the increments of two feet, four feet, six feet, etc. is but a preferred embodiment. The invention contemplates that the incremental lengths could be in 2.5–5.0–7.5 etc. feet increments, in 3–6–9 feet increments, etc.

Lastly, it is understood that the spacing of rafters 20 in a given roof construction can vary. For instance, the rafters may be on twelve-inch centers, twenty four-inch center, etc. Consequently, reference is made to FIG. 6 wherein it can be seen that adjacent attaching flanges 26′ of a pair of baffle vents 10 are joined together to provide a baffle vent structure of a "double-width". For instance, baffle vent structure 10 shown in FIGS. 1–4 may be approximately eleven inches wide for positioning between rafters which are on twelve inch centers. The double-width structure shown in FIG. 6, therefore, would be approximately twenty two inches wide for positioning between rafters on twenty four inch centers. A score line 40 may be provided running the length of the structure between attaching flanges 26′ to provide for ready separation of the double-width construction to thereby provide a pair of separate single-width baffle vents as shown in FIG. 1.

FIG. 5 shows baffle vent structure 10, somewhat schematically installed in a roof construction, positioned against the underside of roof 12 and extending between a soffit area, generally designated 42, of the roof and a vent device 43 upwardly of the roof. Air enters the soffit area of the roof construction, through a vent plate 44, in the direction of arrows "A". The air flows through baffle vent 10, as indicated by dotted arrows "B", and is directed over the interior surface of roof 12 to an upper end of the baffle vent, where the air then flows out through vent device 44 to atmosphere in the direction of arrows "C". Often, insulation 45 is blown into attic constructions beneath roof 12 and becomes compacted in an area, generally designated 46. As stated above, the improved reinforced baffle vent structure of the invention not only resists collapsing of the baffle vent during handling, shipping and installation, but the baffle vent resists collapse due to external forces such as the compacted insulation at 46.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A baffle vent for positioning against the underside of a roof and defining a duct between the vent and the interior surface of the roof for directing air from the soffit area of the roof upwardly over the interior surface of the roof, the duct having a first end with an opening below the roof for admitting air into the duct and a second end with an opening longitudinally spaced from said first end, the baffle vent comprising:

an elongated self-supporting structure of sheet-like material having a generally channel-shaped cross section defining longitudinal side walls joined by a flat generally planar bottom wall, attachment means on the sidewalls for attaching the baffle vent to the underside of the roof, and at least one integral longitudinal reinforcing rib, said longitudinal reinforcing rib having first and second sides tapering crosswise of said structure from an apex of the rib into said bottom wall to define a generally triangular cross-sectional configuration for the rib, said longitudinal reinforcing rib having first and second generally triangularly shaped ramped ends tapering lengthwise of said structure from said sides into said bottom wall, and said longitudinal reinforcing rib extending generally parallel to the sidewalls to resist collapsing of the baffle vent if subjected to external forces such as from roof insulation, handling, shipping and the like.

2. The baffle vent of claim 1 wherein said attachment means comprise flanges integral with and projecting from top edges of said side walls.

3. The baffle vent of claim 1 wherein said structure is fabricated for extruded polystyrene foam material.

4. The baffle vent of claim 1, including a pair of said reinforcing ribs in an in-line orientation and with spaced adjacent ends, and an integral transverse reinforcing rib extending across the bottom wall between the spaced ends of the longitudinal in-line reinforcing ribs.

5. The baffle vent of claim 1, including an integral reinforcing rib extending transversely across the bottom wall at each opposite end of the structure.

6. The baffle vent of claim 1, including a plurality of said reinforcing ribs spaced in an in-line orientation longitudinally of the bottom wall with spaced adjacent ends whereby the structure can be cut to length between adjacent ends of a pair of said spaced in-line ribs.

7. A baffle vent for positioning against the underside of a roof and defining a duct between the vent and the interior surface of the roof for directing air from the soffit area of the roof upwardly over the interior surface of the roof, the duct having a first end with an opening below the roof for admitting air into the duct and a second end with an opening longitudinally spaced from said first end, the baffle vent comprising:

an elongated self-supporting structure of sheet-like material having a generally channel-shaped cross section defining longitudinal side walls joined by a flat generally planar bottom wall, attachment means on the sidewalls for attaching the baffle vent to the underside of the roof, at least one integral longitudinal reinforcing rib in the bottom wall extending lengthwise and generally centrally of the bottom wall and generally parallel to the side walls, said longitudinal reinforcing rib having first and second generally triangularly shaped ramped ends tapering lengthwise of said structure into said bottom wall, said longitudinal reinforcing rib having first and second sides tapering crosswise of said structure from an apex of the rib into said bottom wall to define a generally triangular cross-sectional configuration for the rib, and integral transverse reinforcing ribs extending across the bottom wall at each opposite end of the structure.

8. The baffle of claim 7, including a pair of said longitudinal reinforcing ribs in an in-line orientation and with spaced adjacent ends, and an additional transverse reinforcing rib extending across the bottom wall between the spaced ends of said pair of longitudinal reinforcing ribs.

9. The baffle of claim 7, including a pair of said longitudinal reinforcing ribs spaced in an in-line orientation longitudinally of the bottom wall whereby the structure can be cut to length between adjacent ends of a pair of said longitudinal in-line reinforcing ribs.

10. A baffle vent for positioning against the underside of a roof and defining a duct between the vent and the interior surface of the roof for directing air from the soffit area of the roof upwardly over the interior surface of the roof, the duct having a first end with an opening below the roof for admitting air into the duct and a second end with an opening longitudinally spaced from said first end, the baffle vent comprising:

an elongated self-supporting structure of sheet-like material having a generally channel-shaped cross section including a flat generally planar bottom wall, and a plurality of longitudinal reinforcing ribs of substantially equal length in the bottom wall in an in-line orientation and with spaced adjacent ends whereby the structure can be cut to length between the spaced adjacent ends of a pair of said longitudinal reinforcing ribs, said spaced adjacent ends tapering lengthwise of said structure into said bottom wall, each of said plurality of longitudinal reinforcing ribs having first and second sides tapering crosswise of said structure from an apex of each rib into said bottom wall to define a generally triangular cross-sectional configuration for each of said ribs, and each rib having first and second triangularly shaped ramped ends tapering lengthwise of said structure into said bottom wall.

11. A baffle vent for positioning against the underside of a roof and defining a duct between the vent and the interior surface of the roof for directing air from the soffit area of the roof upwardly over the interior surface of the roof, the duct having a first end with an opening below the roof for admitting air into the duct and a second end with an opening longitudinally spaced from said first end, the baffle vent comprising:

an elongated self-supporting structure of sheet-like material having a generally channel-shaped cross section defining longitudinal side walls joined by a flat generally planar bottom wall, attachment means on the sidewalls for attaching the baffle vent to the underside of the roof, and a plurality of discrete longitudinal reinforcing ribs of substantially equal length and all aligned in a single line and extending lengthwise of the bottom wall to resist collapsing of the baffle vent if subjected to external forces such as from roof insulation, handling, shipping and the like, said longitudinal ribs having first and second ramped ends tapering lengthwise of said structure into said bottom wall.

12. A baffle vent for positioning against the underside of a roof and defining a duct between the vent and the interior surface of the roof for directing air from the soffit area of the roof upwardly over the interior surface of the roof, the duct having a first end with an opening below the roof for admitting air into the duct and a second end with an opening longitudinally spaced from said first end, the baffle vent comprising:

an elongated self-supporting structure of sheet-like material having a generally channel-shaped cross section defining longitudinal side walls joined by a flat generally planar bottom wall, attachment means on the sidewalls for attaching the baffle vent to the underside of the roof, and a plurality of integral reinforcing ribs of generally triangular cross-sectional configurations and spaced in an in-line orientation longitudinally of the bottom wall and with spaced adjacent ends of a pair of said longitudinal in-line reinforcing ribs, said longitudinal ribs having first and second generally triangularly shaped ramped ends tapering lengthwise of said structure into said bottom wall.

13. A baffle vent for positioning against the underside of a roof and defining a duct between the vent and the interior surface of the roof for directing air from the soffit area of the roof over the interior surface of the roof, the duct having a first end with an opening below the roof for admitting air into the duct and a second end with an opening longitudinally spaced from said first end, the baffle vent comprising an elongated self-supporting structure of sheet-like material having a generally channel-shaped cross section defining longitudinal side walls joined by a flat generally planar bottom wall, attachment means on the sidewalls for attaching the baffle vent to the underside of the roof, a pair of integral longitudinal reinforcing ribs of generally triangular cross-sectional configurations extending lengthwise of the bottom wall in an in-line orientation and with spaced adjacent ends, said spaced adjacent ends being generally triangularly shaped and tapering lengthwise of said structure into said bottom wall, and an integral transverse reinforcing rib extending across the bottom wall between adjacent ends of a pair of said longitudinal in-line reinforcing ribs.

14. The baffle vent of claim 4 in which said longitudinal reinforcing ribs and transverse reinforcing rib having a height characterized by the distance which said ribs extend from the bottom wall, the height of said transverse reinforcing rib being less than the height of said longitudinal reinforcing ribs.

* * * * *